US005085069A

United States Patent [19]

Walters, Jr.

[11] Patent Number: 5,085,069

[45] Date of Patent: Feb. 4, 1992

[54] MULIT-PART ROLLING MILL HOUSING

[75] Inventor: James C. Walters, Jr., Louisville, Ky.

[73] Assignee: Steel Technologies, Inc., Louisville, Ky.

[21] Appl. No.: 618,064

[22] Filed: Nov. 26, 1990

[51] Int. Cl.[5] ..... B21B 31/02

[52] U.S. Cl. ..... 72/237; 72/455; 83/859; 100/214

[58] Field of Search ..... 72/237, 238, 244, 245, 72/248, 446, 448, 455; 52/223 R; 83/859; 100/214, 231, 257

[56] References Cited

U.S. PATENT DOCUMENTS

| | | | |
|---|---|---|---|
| 679,413 | 7/1901 | Bunker | 72/244 |
| 2,767,602 | 10/1956 | Henrickson | 72/237 |
| 3,626,740 | 12/1971 | Hinterhölzl | 72/244 |
| 3,717,024 | 2/1973 | Davison | 72/455 |
| 3,895,512 | 7/1975 | Sack | 72/237 |
| 3,938,362 | 2/1976 | Falk et al. | 72/237 |
| 4,453,393 | 6/1984 | Hino et al. | 72/245 |
| 4,537,056 | 8/1985 | Heffentrager | 72/238 |
| 4,768,366 | 9/1988 | Sendzimir | 72/237 |

FOREIGN PATENT DOCUMENTS

| | | | |
|---|---|---|---|
| 625921 | 9/1978 | U.S.S.R. | 83/859 |

*Primary Examiner*—Lowell A. Larson

*Assistant Examiner*—Thomas C. Schoeffler

*Attorney, Agent, or Firm*—Maurice L. Miller, Jr.

[57] ABSTRACT

A multi-part frame structure forming a mill housing for a rolling mill assembly is disclosed. The housing includes six separate and distinct components, namely a bottom separator member, a top separator member spaced above and disposed in registry with the bottom member and four elongated, upstanding columns of rectangular cross-section adjoining the top and bottom separator members to form a substantially rectangular opening for the passage of a steel strip therethrough during cold rolling operations. The top and bottom separator members are each of T-shaped cross-section defining a pair of tee arms which extend transversely across the frame and project forwardly and rearwardly from a tee leg. The tee arms of the top separator member are inserted in close spaced relation in traversely extending notches formed in upper end portions of the four columns. Similiarly, the tee arms of the bottom separator are inserted in close spaced relation in transversely extending notches formed in lower end portions of the four columns. Threaded fasteners connect the four columns to opposing front and rear side portions of the separators to secure the tee arms in the notches. Conventional work and back-up and work rolls, chock blocks for the back-up rolls, and other conventional components of a rolling mill assembly are mountable in the housing in a conventional manner.

8 Claims, 3 Drawing Sheets

FIG. 2
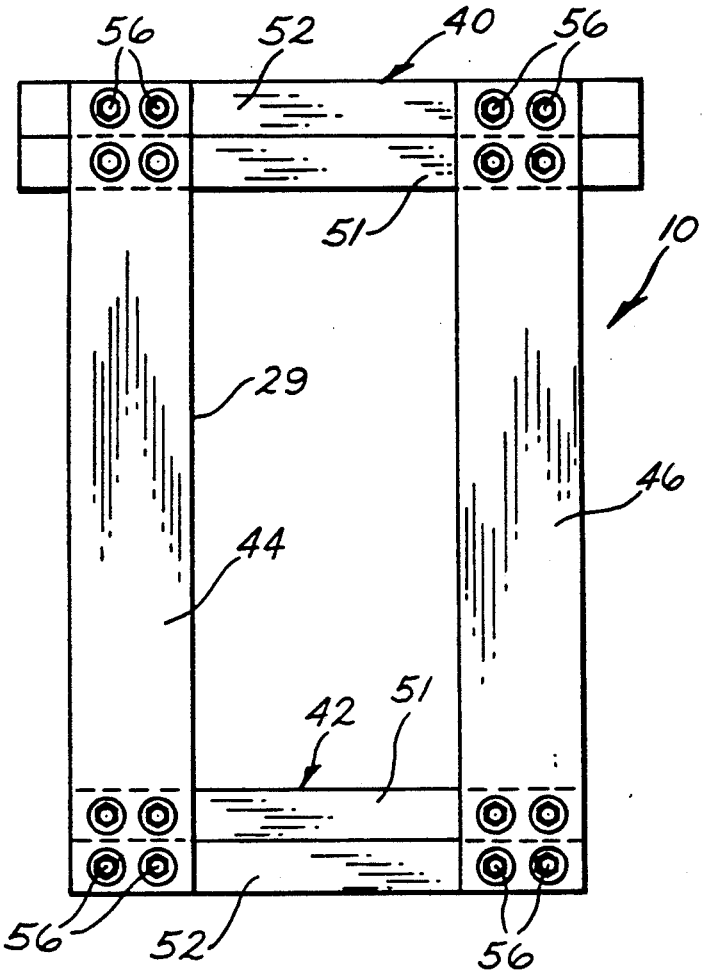
FIG. 4
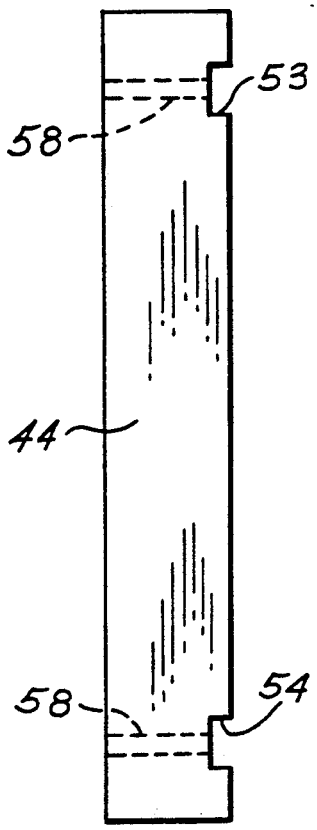
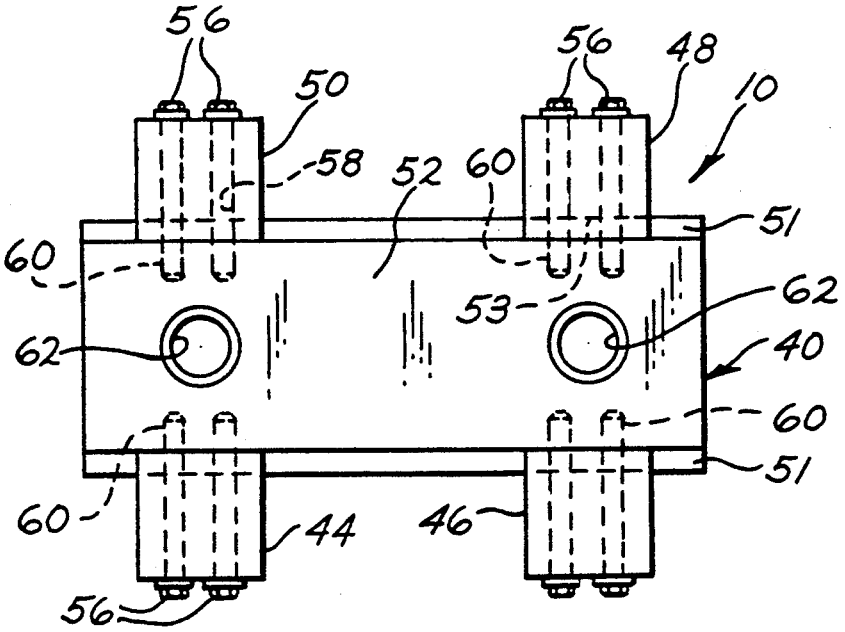
FIG. 3

MULIT-PART ROLLING MILL HOUSING

BACKGROUND OF THE INVENTION

This invention relates to a multi-part machine frame having a substantially rectangular opening for use as a rolling mill housing in the cold rolling of steel strip.

Generally speaking, multi-part mill housings are known in the prior art. See, for example, U.S. Pat. No. 3,895,512 issued to E. T. Sack on July 22, 1975. The reference housing consists of two parallel upstanding longitudinal struts interconnected with upper and lower transverse frame members. A pair of large tie rods pass completely through the upper and lower transverse frame members and through the adjacent struts to secure the four elements of the frame together. In addition, four pre-stressed tie rods extend diagonally through force transmitting ledges or surfaces of adjoining struts and frame members at the four corners of the assembly to prevent separation and hammering of these surfaces when relieving forces occur which act in a direction opposite the working forces.

Such multi-part frames have a decided advantage over the traditional mill housings of the prior art which are massive, one-piece castings. However, the reference frame requires the use of six extremely large tie rods to secure the housing members together and to prevent damage to their force transmitting surfaces due to hammering of the component parts together.

By means of my invention these and other difficulties encountered in the use of multi-part mill housings of the prior art are substantially eliminated.

SUMMARY OF THE INVENTION

It is an object of my invention to provide a multi-part mill housing for use in rolling mill assemblies for the cold rolling of steel strip.

Briefly, in accordance with my invention, there is provided a rolling mill housing for use in an assembly for cold rolling steel strip which includes a tranversely extending bottom separator having a T-shaped cross-section. Also included is a tranversely extending top separator having an inverted T-shaped cross section, the top separator being spaced vertically from and disposed in registry with the bottom separator. Two pairs of elongated, vertically extending columns are provided, each being rectangular in cross-section and defining a pair of spaced apart, transversely extending notches located on opposite end portions thereof which open across the same surface thereof. A first pair of the columns is disposed in spaced apart relation behind the separators on opposite end portions thereof. A second pair of the columns is disposed in spaced apart relation in front of the separators on opposite end portions thereof. Rearwardly and forwardly projecting tee arms of the separators are inserted in close fitting relation in the notches defined by the columns, whereby a substantially rectangular frame opening is formed for the passage of a steel strip therethrough. Fastening means is provided for securing the columns to the separators to secure the tee arms in the notches to form a closely confined composite frame structure.

These and other objects, features and advantages of the present invention will become apparent to those skilled in the art from the following detailed description and attached drawings upon which, by way of example, only a single preferred embodiment of the subject invention is explained and illustrated.

BRIEF DESCRIPTION OF THE DRAWINGS

FIG. 2 shows a front elevation view of the mill housing of FIG. 1 with various rolling mill assembly components being removed.

FIG. 3 shows a top plan view of the mill housing of FIG. 2.

FIG. 4 shows a side elevation view of one of four vertically extending supporting columns of the mill housing of FIGS. 2–3.

DESCRIPTION OF THE PREFERRED EMBODIMENT

Figure 1:
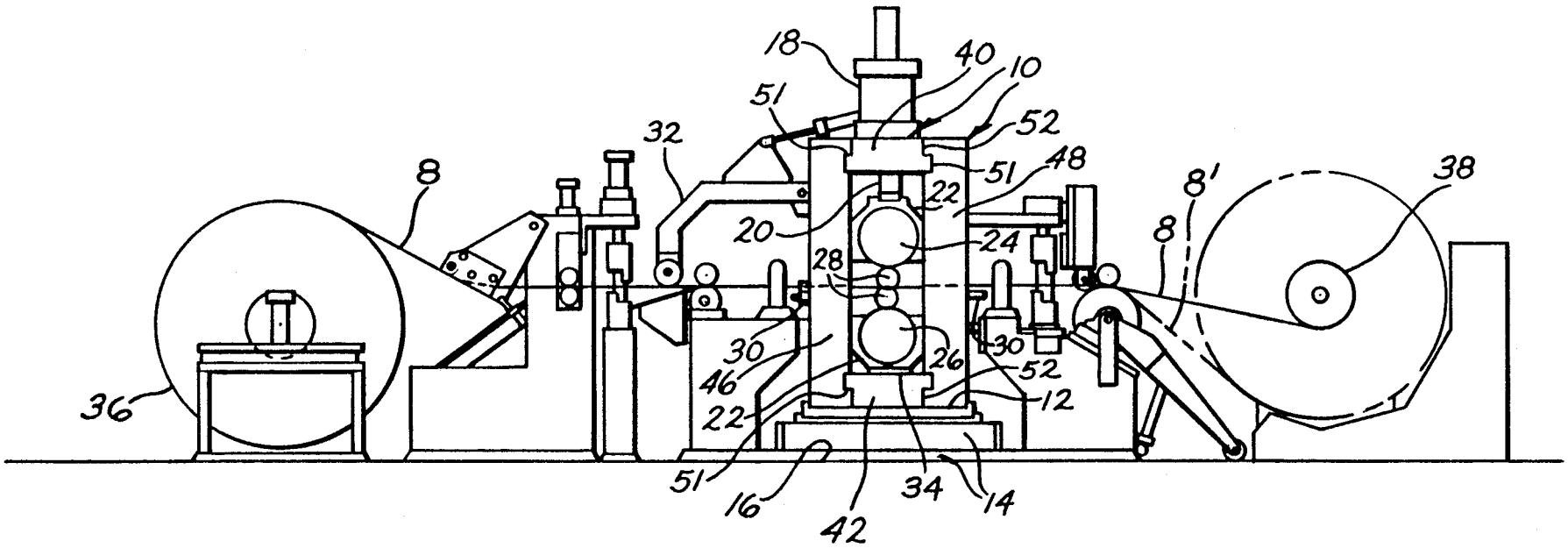
FIG. 1 shows a side elevation view of a rolling mill assembly for use in the cold rolling of sheet strip employing a novel mill housing, thus illustrating a preferred embodiment of my invention.
Figure 5:
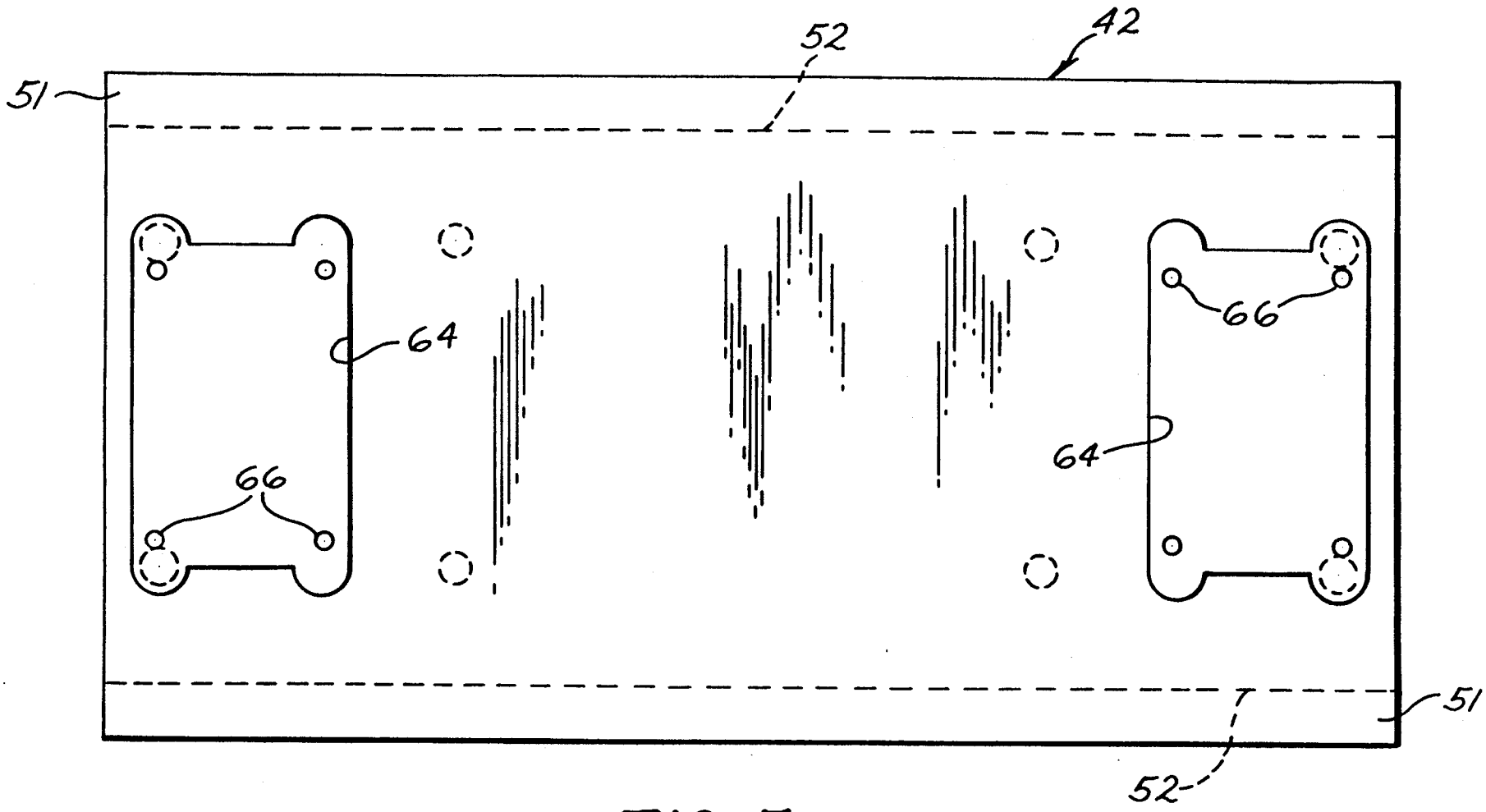
FIG. 5 shows a top plan view of a bottom separator member of the mill housing of FIGS. 2–3.

Referring now to the drawing figures and, in particular, to FIG. 1 there is shown, in a preferred embodiment of my invention a rolling mill assembly for the cold rolling of a steel strip 8. The assembly includes a novel multi-component mill housing 10 disposed on an adapter plate 12, both of which are supported by a coventional base 14 bolted to a floor or foundation 16 in any suitable manner. A number of conventional components are supported by the mill housing 10 such as a pair of hydraulic cylinders 18 and piston rods 20 (only one of each pair being shown in FIG. 1), upper and lower bearing chocks or boxes 22 containing a pair of large back-up rolls 24 and 26, a pair of relatively smaller work rolls 28, a transfer table 30, a pivotal knock-down roller arm 32 and a pair of lower bearing box rocker plates 34, among other conventional components. The strip 8 passes between the work rolls 28 and through a rectangular opening 29 in the mill housing 10 (see FIG. 2) along the transfer table 30 from a rotatably mounted unwinding coil 36 onto and around a rotatably mounted recoiler or winder 38, all in a conventional, well known manner.

Referring now also to the remaining drawing figures, the mill housing 10 includes six separately formed and distinct components including a transversely extending top separator 40, a transversely extending bottom separator 42, and four upstanding columns 44, 46, 48 and 50. The top and bottom separators 40 and 42 are T-shaped as viewed from their ends as in FIG. 1, with the former being inverted, the tee arms or steps 51 of which extend outward from a base leg 52 along their entire length and are inserted in close fitting relationship in upper and lower notches 53 and 54, respectively, formed in opposing surface portions of the four columns 44 through 50. Upper and lower end portions of each of the columns 44 through 50 are bolted to opposing surfaces of the top and bottom separators 40 and 42 by means of four bolts 56 arranged in rectangular arrays. The bolts 56 pass through untapped shafts 58 drilled through each of the columns 44 through 50 and are threadably inserted into tapped blind holes 60 formed in opposing front and rear surface portions of the tee arms 51 and legs and 52. With regard to each of the rectangular arrays of the bolts 56, two are threadably inserted into the tee arm 51 and the other two are threadably inserted into the tee leg 52 in the separators 40 and 42.

I prefer forming the six components of the mill housing 10 from six pieces of either hot rolled, high carbon steel plate or a suitable hot rolled, high strength, alloy steel plate which, in either case, has been flame cut to the desired starting deminsions and annealed. Such work pieces can then be rotary ground to the desired final dimensions with relative precision using a conventional Blanchard rotary grinder of the type widely used in machine shops throughout the United States. The notches 53 and 54 can be machined with great uniformity by first stacking and aligning the four work pieces which will ultimately form the columns lengthwise. Once stacked, all four work pieces are machined together to the precise width, depth and length desired in three machining operations. Thereafter, the notches 53 or 54 which are to be formed on a corresponding end portion of each of the four columns 44–50 are located and machined in a single operation. Similarly, the notches 53 or 54 which one to be formed on the opposite corresponding end portions of the columns 44–50 are then located and machined in a single operation.

The upper and lower edges of the notches 53 and 54, thus formed, are chamfered 1/16 inch at 45 degrees and polished. A conventional high quality anti-seize compound is then applied to the notches 53 and 54 and to the threads and undersides of the heads of the bolts 56, all to facilitate the gradual insertion and eventual removal of the tee arms or steps 51 of the top and bottom separators 40 and 42 into and out of the upper and lower notches 53 and 54, respectively.

The two work pieces which are to form the top and bottom separators 40 and 42 are likewise machined to the desired length, width and depths and the steps 51 are machined therein. I have constructed such a mill housing 10 wherein the upper and lower notches 53 and 54 are machined to a depth of 2.010+/−0.005 inches and to a height of between 5.000 and 5.0015 inches while holding 63.000 inches between the lower defining surfaces of the upper and lower notches 53 and 54 and while holding from 4.9980 to 4.9965 inches from the lower end of the lower notches 54 to the lower ends of the stacked columns 44–50. The steps 51 of the upper and lower separators 40 and 42 are machined to a depth of 2.000+/−0.002 inches and to a height of between 4.9965 and 4.9980 inches. The upper and lower edges of the steps are also chamfered 1/16 inch at 45 degrees and polished to facilitate their insertion into the notches 53 and 54. Upon completion of the steps 51, the holes 58 are drilled and tapped into opposite end portions of the front and rear surface portions of the separators 40 and 42 and untapped shafts 60 are drilled through opposing ends of the columns 44–50, taking care to align the holes 58 and shafts 60 to accomodate the bolts 56. A pair of shafts 62 for the piston rods 20 (see FIG. 3) are drilled through the top separator 40 and depressions 64 are machined in an upper surface portion of the bottom separator 42 along with suitably tapped bolt holes 66 to accomodate the lower bearing box rocker plates 34.

The tee arms 51 of one of the separators 40 or 42 are aligned for insertion into either the upper or lower notches 53 and 54 of the columns 44-50, as the case may be, such that the untapped shafts 58 register with corresponding tapped holes 60. Each bolt 56 is then inserted and tightened in sequence no more than one-quarter turn at a time to thus gradually draw the separator tee arms 51 into the column notches 53 and 54 until finally the front and rear surfaces of the tee leg 52 contact opposing faces of the columns 44–50. Tightening of the bolts 56 is then completed by torquing all eight bolts 56 at the top and bottom of a given column in sequence in three steps of 800, 1800 and finally 2500 ft lbs. Because of the extremely close fit between the notches 53 and 54 and the tee arms 51, the structure of the mill housing 10 acts very much like a unitary assembly frame similar to the extremely massive unitary casting's of mill housings of the prior art, whereby the notches 53 and 54 receive little if any impact loading or pounding when the structure is used in a strip steel cold rolling assembly.

Although the present invention has been described with respect to specific details of a certain preferred embodiment thereof, it is not intended that such details limit the scope of this patent other than as specifically set forth in the following claims.

I claim:

1. A rolling mill housing for use in an assembly for rolling steel strip comprising a transversely extending bottom separator of unitary construction having a T-shaped cross section which includes an upper T-arm portion and a lower T-leg portion, said upper portion extending forwardly and rearwardly beyond vertically extending forwardly and rearwardly facing surfaces of said lower portion, a transversely extending top separator having an inverted T-shaped cross-section which includes an upper T-leg portion and a lower T-arm portion, said lower T-arm portion extending beyond vertically extending forwardly and rearwardly facing surfaces of said upper T-leg portion, said top separator being vertically spaced from and disposed in registry with said bottom separator, two pairs of elongated vertically extending columns, each of said columns being rectangular in cross-section and defining a pair of spaced apart, transversely extending notches located on opposite end portions thereof, a first pair of said columns being disposed in spaced apart relation behind said separators on opposite side edge portions thereof and a second pair of said columns being disposed in spaced apart relation in front of said separators on opposite edge portions thereof, rearwardly and forwardly projecting T-arms of said separators being inserted in close fitting relation in said notches to form a substantially rectangular frame opening for the passage of a steel strip therethrough, and fastening means connected directly between upper and lower end portions of said columns, and both through said notches into said T-arms and adjacent said notches into said T-legs of both said top and bottom separators for securing said T-arms in said notches in close fitting relation.

2. The housing of claim 1 wherein upper and lower transversely extending edges of said T-arms and notches are chamfered and polished to facilitate insertion and removal of said T-arms into and from said notches.

3. The housing of claim 1 wherein said top separator supports cylinder and piston means from which an upper back-up roll is supported and positioned.

4. The housing of claim 1 wherein said bottom separator supports a chock box containing a lower back-up roll disposed in said housing.

5. The housing of claim 1 wherein said separators and columns are constructed of a material selected from the group consisting of hot rolled, high carbon steel plate and hot rolled, high strength alloy steel plate.

6. The housing of claim 1 wherein said fastening means comprises fasteners which extend through untapped shafts in upper and lower end portions of said columns and which are threadably inserted into surface portions of both the T-arms and T-legs of each of said separators.

7. The housing of claim 6 wherein said fasteners comprise a series of threaded bolts.

8. The housing of claim 7 further comprising a quantity of anti-seize compound applied in said notches and to the threads and underside of the heads of said bolts to facilitate insertion and removal of the T-arms of said separators into and from said notches.

* * * * *